US010400319B2

(12) United States Patent
Mesplont et al.

(10) Patent No.: US 10,400,319 B2
(45) Date of Patent: Sep. 3, 2019

(54) FORCED WATER COOLING OF THICK STEEL WIRES

(71) Applicant: NV BEKAERT SA, Zwevegem (BE)

(72) Inventors: Christophe Mesplont, Mouvaux (FR); Davy Poelman, Waarschoot (BE)

(73) Assignee: NV BEKAERT SA, Zwevegem (BE)

( * ) Notice: Subject to any disclaimer, the term of this patent is extended or adjusted under 35 U.S.C. 154(b) by 969 days.

(21) Appl. No.: 14/764,264

(22) PCT Filed: Jan. 24, 2014

(86) PCT No.: PCT/EP2014/051407
§ 371 (c)(1),
(2) Date: Jul. 29, 2015

(87) PCT Pub. No.: WO2014/118089
PCT Pub. Date: Aug. 7, 2014

(65) Prior Publication Data

US 2015/0361536 A1 Dec. 17, 2015

(30) Foreign Application Priority Data

Feb. 1, 2013 (EP) ..... 13153642

(51) Int. Cl.
*C22C 38/60* (2006.01)
*C21D 9/52* (2006.01)
(Continued)

(52) U.S. Cl.
CPC ..... *C22C 38/60* (2013.01); *C21D 1/18* (2013.01); *C21D 1/63* (2013.01); *C21D 1/64* (2013.01); *C21D 6/002* (2013.01); *C21D 6/005* (2013.01); *C21D 6/008* (2013.01); *C21D 9/0006* (2013.01); *C21D 9/525* (2013.01); *C21D 9/573* (2013.01);
(Continued)

(58) Field of Classification Search
CPC ... C21D 1/18; C21D 1/63; C21D 1/64; C21D 2211/009; C21D 6/002; C21D 6/005; C21D 6/008; C21D 9/0006; C21D 9/525; C21D 9/573; C22C 38/02; C22C 38/04;
(Continued)

(56) References Cited

U.S. PATENT DOCUMENTS 4,595,425 A 6/1986 Harding
6,228,188 B1 5/2001 Meersschaut et al.

FOREIGN PATENT DOCUMENTS

EP 0 216 434 A1 4/1987
EP 0 524 689 A1 1/1993
(Continued)

OTHER PUBLICATIONS

English Machine Translation of JP 2007-056300. (Year: 2007).*
(Continued)

*Primary Examiner* — Veronica F Faison
(74) *Attorney, Agent, or Firm* — Foley & Lardner LLP

(57) ABSTRACT

A method of and an equipment for controlled cooling of one or multiple previously heated, straight, and thick steel wire to a predetermined temperature range between 400° C. and 650° C. Each of the thick steel wires is subjected to a controlled cooling-transformation treatment from austenite to pearlite, which occurs substantially after the wire leaves a forced water cooling length.

16 Claims, 4 Drawing Sheets

Figure 1:
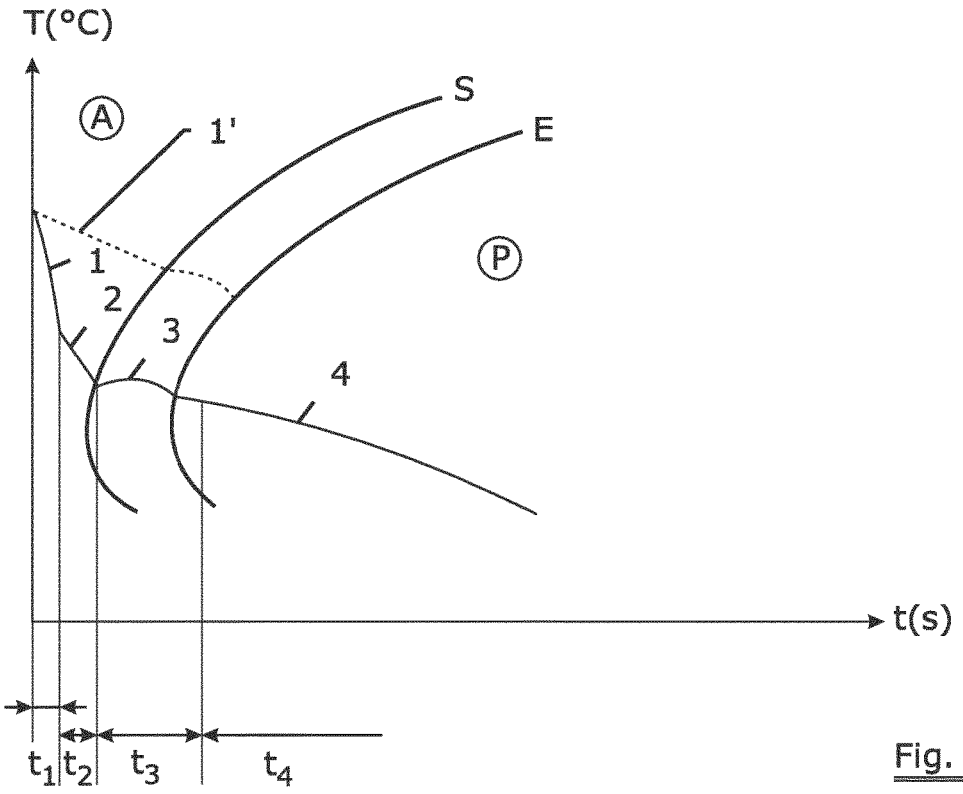

(51) Int. Cl.

| | |
|---|---|
| ***C21D 9/573*** | (2006.01) |
| ***C21D 1/63*** | (2006.01) |
| ***C21D 1/64*** | (2006.01) |
| ***C21D 1/18*** | (2006.01) |
| ***C21D 6/00*** | (2006.01) |
| ***C21D 9/00*** | (2006.01) |
| ***C22C 38/02*** | (2006.01) |
| ***C22C 38/04*** | (2006.01) |
| ***C22C 38/12*** | (2006.01) |
| ***C22C 38/16*** | (2006.01) |
| ***C22C 38/20*** | (2006.01) |
| ***C22C 38/24*** | (2006.01) |

(52) U.S. Cl.
CPC ..... *C22C 38/02* (2013.01); *C22C 38/04* (2013.01); *C22C 38/12* (2013.01); *C22C 38/16* (2013.01); *C22C 38/20* (2013.01); *C22C 38/24* (2013.01); *C21D 2211/009* (2013.01)

(58) Field of Classification Search
CPC ..... C22C 38/12; C22C 38/16; C22C 38/20; C22C 38/24; C22C 38/60
See application file for complete search history.

(56) References Cited

FOREIGN PATENT DOCUMENTS

| | | | | |
|---|---|---|---|---|
| EP | 0524689 | A1 * | 1/1993 | ..... C21D 9/525 |
| GB | 1 276 738 | | 6/1972 | |
| JP | 60-9834 | A | 1/1985 | |
| JP | 2007056300 | A * | 3/2007 | ..... C21D 1/63 |
| WO | WO 2007/023696 | A1 | 3/2007 | |
| WO | WO 2012/085651 | A1 | 6/2012 | |

OTHER PUBLICATIONS

K. J. Mason et al., The Use of Polymer Quenchants for the Patenting of High-Carbon Steel Wire and Rod, Heat Treatment of Metals, 1982, pp. 77-83.

* cited by examiner

FORCED WATER COOLING OF THICK STEEL WIRES

TECHNICAL FIELD

The present invention relates to a method and an equipment for controlled cooling of steel wires.

BACKGROUND ART

Heat treatment of steel wires usually plays an important role in the art of wire-making. The first step in wire-making starts with drawing a wire rod to a desired intermediate diameter which can vary from 1.0 to 5.0 mm or more. At this stage of work-hardening the drawn wires are heat treated to pearlite by a patenting process to enable further plastic deformation. Subsequently, the patented steel wires are drawn to a smaller size, either a second intermediate size or a final diameter. Patenting involves heating carbon steel wires into the austenitic phase, generally above 800° C. and then cooling the wires to a chosen temperature held for a sufficient period for generally isothermal decomposition of the austenite to be completed. The temperature is usually in the region of 550° C., with the intention being generally to provide a fine pearlite structure.

As is well known, steel wire rod made by hot rolling from ingots or billets is applied to practical use in the rolled state but after having been subjected to a controlled cooling. In order to cool the high carbon rod immediately after having been hot-rolled to have an excellent cold-workability, it was proposed to dip the high carbon rod into a warm water bath as described in GB 1 276 738. The method of heat-treating a steel wire rod with a wire rod diameter ranging between 5.5 mm and 6.5 mm disclosed in this document comprises dipping the wire rod maintained at a temperature of from 600° C. to 1100° C. into a warm water bath containing a surface active agent. The water is held at a temperature higher than 45° C. thus generating a steam film uniformly on the wire rod surface and thereby controlling the cooling velocity of the wire rod. The essential point of this heat-treating method is to generate the steam film uniformly on the wire rod surface and to keep this state for some period of time until pearlite transformation has finished. Such a method has various merits when used in the direct cooling of hot rolled rods transported in spiral coils on a horizontal conveyor. However, this method has been regarded as being less suitable or unreliable for treatment of wires with other diameters.

Regarding the heat treatment of drawn wires having a desired intermediate diameter which can vary from 1.5 to 5.0 mm, EP 0 216 434 discloses another suitable and reliable method of controlled cooling of previously heated steel wire to an austenite temperature: the wire is transported continuously through a coolant bath containing substantially pure water of at least 80° C. and is immersed in the bath so as to effect a cooling to pearlite without producing martensite or bainite. The wire is subjected to uniform and stable film-boiled cooling along its entire immersion length by contacting the wire with a continuous non-turbulent flow of the substantially pure water. The water patented wires feature a sufficiently uniform pearlitic microstructure with excellent drawability records.

EP 0 524 689 also makes use of water of at least 80° C. as the coolant for the steel wire having a diameter which is less than 2.8 mm, but not continuously through a coolant bath as the aforementioned method disclosed in EP 0 216 434. Austenite to pearlite transformation may also be done in a water bath, however, if there is only one water bath provided, it may give problems for wire diameters smaller than 2.8 mm and even becomes impossible for wire diameters smaller than about 1.8 mm as the cooling velocity/speed of such a steel wire is too fast, which further causes unfavourable metallic structure of the patented steel wire. Thus, as an example desclosed in this EP patent, there are two water baths with air cooling in-between. The cooling is alternating done by film boiling in water during one or more water cooling periods and in air during one or more air cooling periods. A water cooling period immediately follows an air cooling period and vice versa, which is named as a "water-air-water patenting" process. The number of the water cooling periods, the number of the air cooling periods, the length of each water cooling period and the length of each air cooling period are so chosen so as to avoid the formation of martensite or bainite.

As explained in EP 0 524 689, all other technical parameters such as steel composition, coolant bath composition, temperature . . . being kept equal, the diameter of the wire plays a crucial part in the cooling speed. The smaller the diameter the greater the cooling speed, the greater the diameter the smaller the cooling speed.

WO2007/023696 relates to a direct heat treatment method of a loose coil-like rolled wire rod having a diameter more than 11.0 mm. The coil-like rolled wire rod are cooled by immersing them into refrigerant or exposing them to refrigerant flow.

Up to now prior attempts to use the aforementioned methods for the purpose of effecting a cooling-transformation of drawn and austenitized thick steel wires to pearlite, have been largely unsuccessful in many respects. The results of the heat treatment are too often unreliable and the treated thick wires show too high a variation in properties such as inconsistent drawability and frequently unexpected brittle behaviour because of numerous undesirable metallic structures. The exact metallic structure of the patented wire not only determines the absence or presence of wire fractures during the subsequent wire drawing but also determines to a large extent the mechanical properties of the wire at its final diameter. In this way, transformation conditions must be such that martensite or bainite are avoided even at very local spots on the steel wire surface. On the other hand, the metallic structure of the patented steel wire must not be too soft, i.e. it must not present too coarse a pearlite structure or too great a quantity of ferrite, since such a metallic structure would never yield the desired ultimate tensile strength of the steel wire. According to the statement of the previous paragraph, the essential point of carrying out a reliable thick wires' transformation-cooling is to accelerate cooling intentionally based on a conventional wire heat treatment process.

DISCLOSURE OF INVENTION

The primary object of the invention is to provide an alternative controlled cooling process.

Another object of the present invention is to give patented steel wires with a proper metallic structure, i.e. a fine pearlite structure without any martensitic or bainitic spots.

It is still another object of the present invention to provide a process which is suitable for transformation from austenite to pearlite of steel wires with a diameter greater than 5.0 mm, e.g. greater than 8.0 mm.

According a first aspect of the invention there is provided a method of controlled cooling of one or multiple previously heated and substantially straight steel wire to a predetermined temperature range, the method comprises the steps of:

guiding said heated and substantially straight steel wire/wires along individual path/paths through a coolant bath, said coolant bath comprising as bath liquid water and a stabilizing polymer, said bath liquid having a temperature of more than 80° C., said bath liquid and said multiple previously heated and substantially straight steel wires creating a steam film around each steel wire itself along each individual path;

directing an impinging liquid immersed inside said coolant bath towards said steam film over a certain length L along individual path/paths, in order to decrease the thickness of said steam film or to destabilize said steam film, thereby increasing the speed of cooling over said length L along individual path/paths;

said certain length L is defined as "forced water cooling length".

In the present invention, the controlled cooling method relates to one or multiple substantially straight lines of steel wires. These steel wires pass through the coolant bath along individual paths. In the other words, the paths in the coolant bath are substantially straight. Therefore, the paths of each steel wire are well defined. Normally, the coolant bath may have a rectangular shape and the paths of steel wires are substantially parallel to one side of the rectangular shaped coolant bath. This make it possible to direct an impinging liquid immersed inside the coolant bath towards the steam film on the steel wires. For instance, the imping liquid can come below the steel wires, towards said steel wires (or said steam film) and along the individual paths. Thus, the steam film can be destabilized or the thickness of the steam film is decreased. As a comparison, this advantage cannot be realized by the solution mentioned in WO2007/023696A1 where a loose coil-like hot rolled wire rods are cooled with refrigerant. The loose coil-like hot rolled wire rods are conveying by a conveyor through the refrigerant tank. A boiled water or gas-liquid mixture are injected to the refrigerant from nozzles immersed within the refrigerant tank, while making the refrigerant in the refrigerant tank flow and relieving the dispersion/variation in a coolant temperature. In WO2007/023696A1, it is trying to suppress the cooling nonuniformity of the wire by creating turbulence in the refrigerant tank by ejecting gas-liquid mixture into the refrigerant tank. The steam film on the steel wire is not really destabilized or at least is not uniformly destabilized over the whole length of the coil-like wire rods since the hot rolled wire rods are in a loose coil-like form. For the coil-like hot rolled wire rods, the closer to the nozzles the more destabilization of the steam film. The nozzles of WO2007/023696A1 are arranged in a line or in three lines. The distance of the coil-like steel wire rods from the nozzles depends on the location on the coil and thus the cooling of the coil-like steel wire rods are also location dependent. The effect of the turbulence in the refrigerant tank on the steam film of the steel wires are not comparable to direct an impinging liquid towards the steam films according to the present invention.

Another advantage of the present invention is that the controlled cooling method can be applied to multiple lines of steel wires. Preferably, the multiple lines of steel wires are parallel to each other. The pattern of impinging liquid immersed inside the coolant bath can be flexibly designed for each individual steel wires. For instance, each steel wire can have a same impinging liquid pattern. Alternatively, impinging liquid can be immersed partially below some of the multiple said previously heated and substantially straight steel wires along their individual paths. It makes possible that multiple steel wires can have different impinging liquid pattern and thus different cooling scheme as desired in a same coolant bath.

According to an embodiment of the invention, the previously heated steel wire/wires is/are subjected to a controlled cooling-transformation treatment from austenite to pearlite. Said steel wire/wires is/are previously heated above austenitizing temperature and cooled at a predetermined temperature range from 400° C. to 650° C. in order to allow transformation from austenite to pearlite, preferably at the temperature of 580° C.

When the steel wire has been heated above the austenitizing temperature the cooling stage comprises a pre-transformation stage, a transformation stage and a post-transformation stage. The lengths of the process, e.g. the forced water cooling length L and the length of conventional water cooling during the pre-transformation stage are preferably so chosen so as to start the transformation from austenite to pearlite at a temperature between 400° C. and 650° C., which allows a patented steel wire with suitable mechanical properties.

Preferably to carry out this method, the forced water cooling length L is smaller than the length of the coolant bath. Usually the pre-transformation stage consists of the whole forced water cooling period and of only a short length of subsequent conventional water cooling period. During this forced water cooling period the steel wire is initially cooled rapidly and then go through a short "soft" conventional water patenting length where this rapid cooling is slowed down so as to enter the "nose" of transformation curve at a proper place—following a predetermined cooling curve (TTT diagram).

Relating to the transformation stage, the complete transformation from austenite to pearlite may occur in the coolant bath, substantially after the wire leaves the forced water cooling process. Cooling in the post-transformation stage may be done in air. Preferably the cooling by air or in air is not a forced air cooling but a simple cooling in ambient air.

In carrying out this cooling-transformation method as a substitute for a conventional heat treatment, i.e. WAP (water-air patenting, one over-flow water bath followed by ambient air), the steel wires are allowed to cool from austenitization temperature and then transform to pearlite. The principle is quite simple but needs to be well controlled. By way of example, the flow rate of the impinging liquid has to be carefully tuned in order to have a desired destabilization of steam film or reduction in thickness of steam film. Instead of using a separated system with cold water and impinging liquid like in many cooling or patenting installations, this new concept uses the same cooling solution as for WAP—the chemical composition of the impinging liquid and the liquid in the coolant bath is the same. This brings two major advantages: one is much lower cost of installation (uses the same tank and cooling liquid); the other is reducing the temperature gradient between the core and the surface of the wire (no direct contact with cold water, thinner steam film cooling), leading to still homogeneous patented structure.

More preferably, the impinging liquid is taken from the coolant bath itself and can be continuously recirculated, e.g. by means of a circulation pump, which further helps to generate a considerably homogeneous solution within the whole coolant bath, which brings a stable cooling system.

The term "liquid" refers to water where additives may have been added to. The additives may comprise surface active agents such as soap, polyvinyl alcohol and polymer quenchants such as alkalipolyacrylates or sodium polyacrylate (e.g. AQUAQUENCH 110®, see e.g. K. J. Mason and T. Griffin, The Use of Polymer Quenchants for the Patenting of High-carbon Steel Wire and Rod, Heat Treatment of Metals, 1982.3, pp 77-83). The additives are used to increase the thickness and stability of the vapour film around the steel wire. The water temperature is preferably more than 80° C., e.g. 85° C., most preferably above 90° C., e.g. around 95° C. The higher the water temperature, the higher the stability of the vapour film around the steel wire.

In a classical WAP installation the cooling speed of the wire depends mainly on its diameter (and to a lesser extent to the temperature and polymer concentration of the cooling liquid). With the forced water cooling process according to this invention, immersed impinging liquid reduces the thickness of the steam film, increases the cooling speed, and the forced water cooling length L can be adjusted to control the transformation temperature.

Forced water cooling is conveniently done in a coolant bath where the steel wire/wires is/are guided continuously along individual path/paths. A horizontal and rectilinear path is preferable to provide the travelling channel for each steel wire. The bath is usually of the overflow-type, the same as the conventional coolant bath. Preferably, there is provided an impinging liquid by a plurality of jets from holes immersed inside said coolant bath below the steel wire itself along each individual path. One of the advantages of having the jets below the steel wires is that one can easily reach and arrange the steel wires without being hindered by the jets.

A plurality of jets from the immersed holes are adapted to rectilinearly direct towards the steam films, e.g. perpendicular to the wire or wires so as to have an effective impact on the steam films—destabilize said steam films, or decrease the thickness of the steam films, further to increase the cooling speed of the thick steel wire or wires. The flow rate of the impinging liquid from the holes may be controlled by the pump. The pump flow rate has a direct influence on the destabilization of the steam films or the decreasing degree of the thickness and further the cooling speed. In general, the higher the pump flow rate, the more stinging the impinging towards the steam films, thus the higher the cooling speed. Of course, different pump flow rates can not only lead to different cooling speeds, but also different positions of the start of transformation ultimately.

According to the invention, the terms "thick wires" refer to wires with a diameter greater than 5.0 mm; preferably, the diameter ranges from 5.5 mm to 20 mm and more preferably, from 6.5 mm to 13.5 mm, e.g. 7.0 mm; 8.0 mm; 9.0 mm.

For steel wire diameters of about 5 mm and more, by way of example, 6 mm, the pump flow rate in the forced water cooling period may be not so high as a very fast cooling speed is not necessary for such not very thick steel wires. If the cooling speed is too fast, the cooling curve will pass by the nose of the transformation curve and bainite or martensite risks to be formed.

In extreme cases, for very thick diameters, e.g. more than 13 mm, the pump flow rate in the forced water cooling period is requested to be significantly high so as to obtain a sufficient destabilization or a much thinner steam film further to have a rapid cooling speed.

According a second aspect of the invention, there is provided an equipment for controlled cooling of one or multiple previously heated and substantially straight steel wire to a predetermined temperature range according to the first aspect of the invention.

This equipment preferably comprises:

a) a coolant bath, said coolant bath comprising water and a stabilizing polymer as bath liquid, said bath liquid having a temperature of more than 80° C.;

b) guiding means for guiding previously heated steel wire/wires continuously along individual path/paths through said coolant bath;

c) an impinging liquid immersed inside said coolant bath being adapted to jet towards each steel wire along individual path.

The equipment may comprise means for conveying an austenitized thick steel wire or a plurality of austenitized thick steel wires continuously along individual path/paths to a coolant bath through which the wires are passed horizontally for a predetermined immersion length. This predetermined immersion length is equal to the sum of a length of forced cooling and a length of non-forced cooling or soft cooling. Within the length of forced cooling, the wires are contacted with a predominantly laminar flow of a water coolant having a constant temperature of more than 80° C. and processing a sufficient purity so as to achieve and to maintain stable film boiled cooling without inducing local nucleate boiling and quench martensite formation, while an impinging liquid is provided by a plurality of jets from the holes immersed inside said coolant bath directing towards said steam films over a certain length L, in order to destabilize said steam films or decrease the thickness of said steam films over the length L. This can be controlled by a circulation pump outside the coolant bath. Thereafter, within the length of non-forced cooling or soft cooling, the wires are cooled during immersion at the same coolant bath at a stage of conventional water patenting process to a desired temperature range of pearlite transformation.

This equipment has the advantage of low investment costs and low running costs. It is quite easy to adapt a conventional WAP equipment to a forced water cooling equipment according to this invention. The equipment according to this invention is not only applied to cool a plurality of previously heated steel wires with the same diameter but also a plurality of previously heated steel wires with different diameters, which is realized by means of adjusting the total immersion length separately and individually for each wire and/or by adjusting forced water cooling length L separately and individually along each individual path.

BRIEF DESCRIPTION OF FIGURES IN THE DRAWINGS

Figure 2:
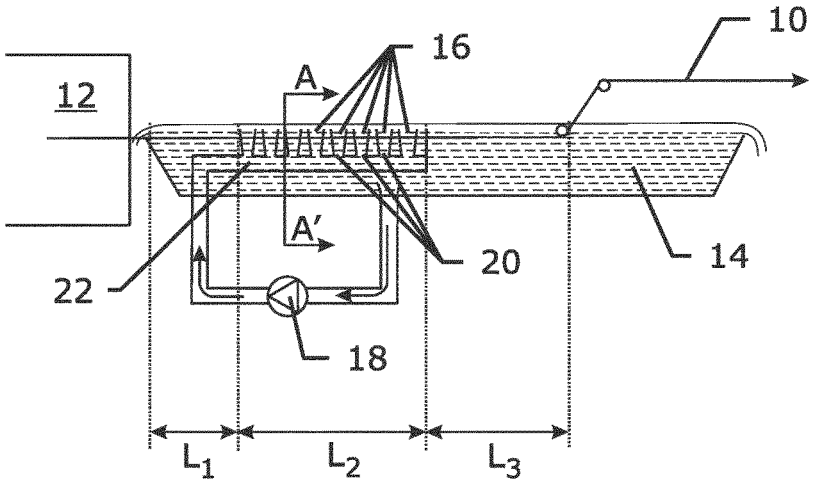
Figure 3:
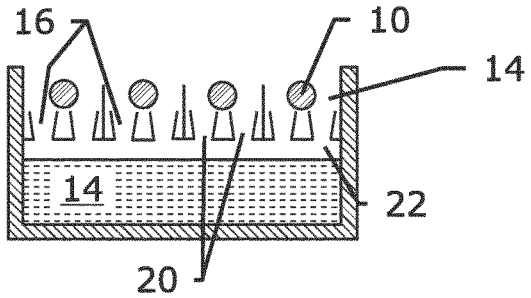
Figure 4:
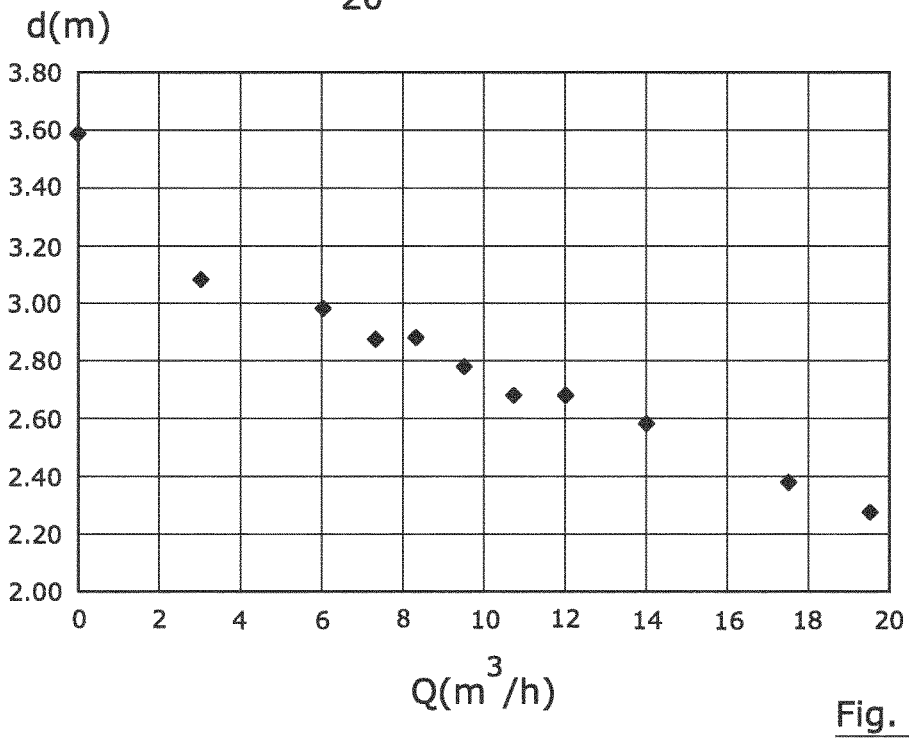
Figure 5:
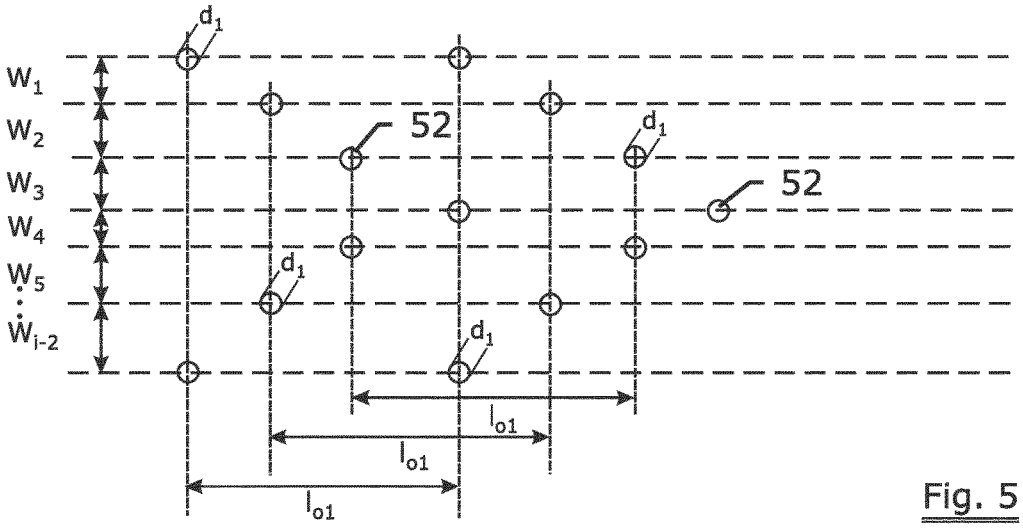
Figure 6:
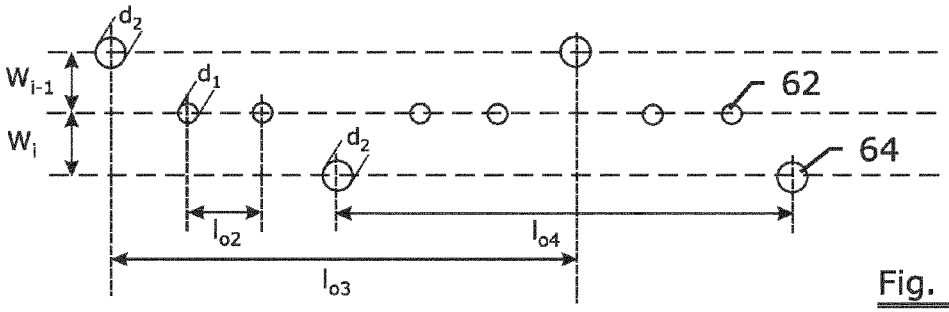
Figure 7:
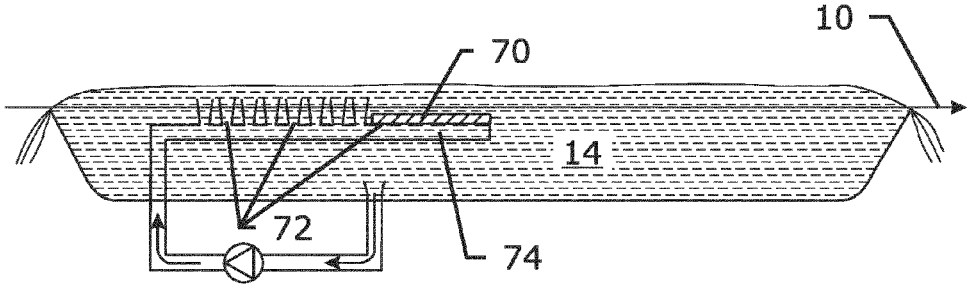
Figure 8:
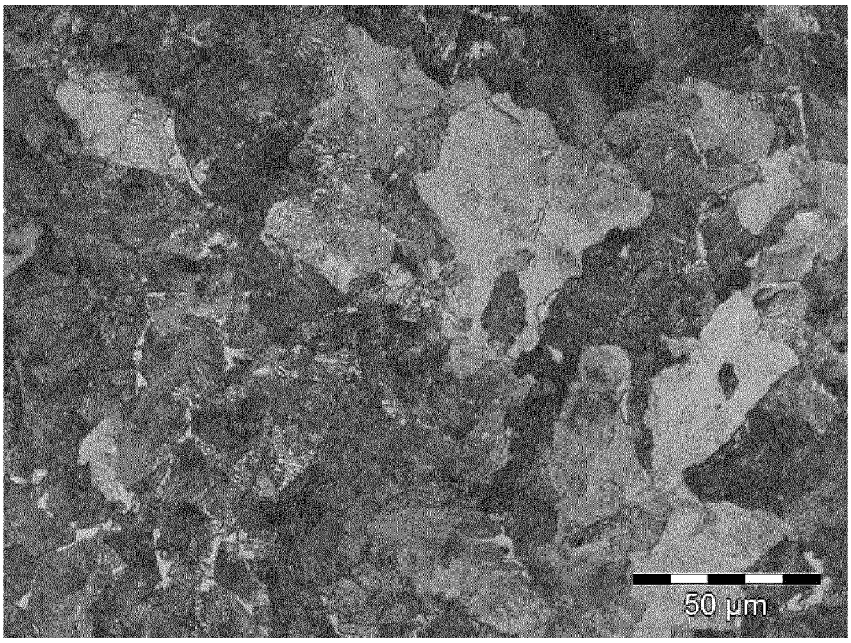
Figure 9:
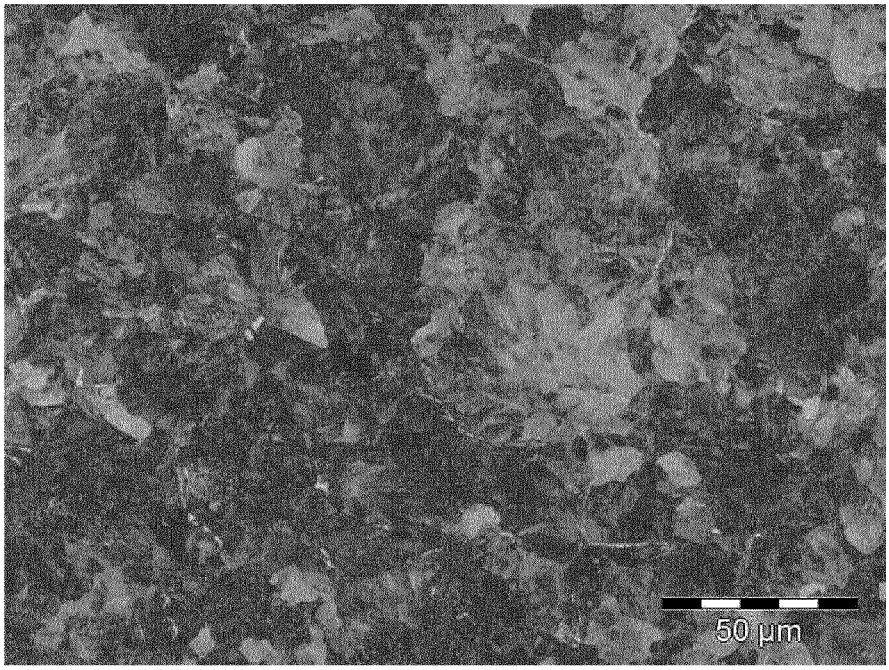
Figure 10:
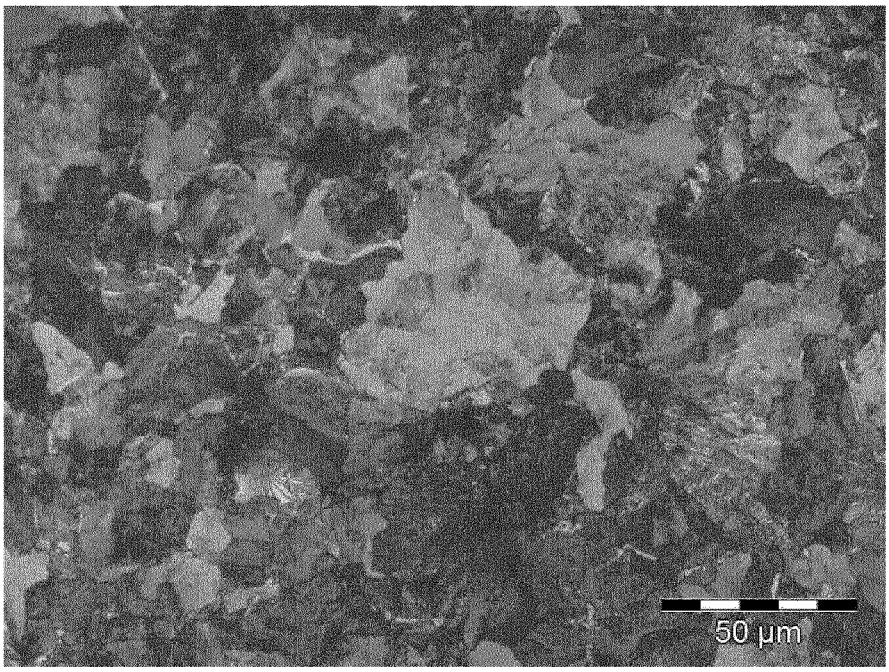

FIG. 1 shows a cooling curve of a process according to the present invention;

FIG. 2 gives schematic representation of carrying out a cooling process according to the present invention;

FIG. 3 gives a cross-section along plane A-A of FIG. 2;

FIG. 4 illustrates the influence of pump flow rate to start of transformation;

FIG. 5 and FIG. 6 give two embodiments of holes with different distributions;

FIG. 7 illustrates the working principle of a movable steel plate for controlling the numbers of the holes;

FIG. 8 and FIG. 9 and FIG. 10 are reference microstructures of sample 1 and sample 2 and sample 3 according to the invention.

MODE(S) FOR CARRYING OUT THE INVENTION

General description of influence of diameter on cooling speed with respect to TTT diagram of FIG. 1. FIG. 1 shows a cooling curve 1-4 in a so-called TTT diagram (Temperature-Time-Transformation). Time is presented in abscissa and temperature forms the ordinate. S is the curve which designates the start of the transformation from austenite (A) to pearlite (P), E is the curve which designates the end of this transformation. A steel wire with a diameter of about 6.50 mm which is cooled by film boiling in an overflow water bath (a conventional WAP process) follows the full dotted lines of cooling curve 1'. The dotted lines of cooling curve 1' do not reach the "nose". It takes a much longer time to start transformation, which will result in too coarse a pearlite structure. Such a structure takes a high risk of yielding a desired ultimate tensile strength of the steel wire. So the cooling speed of the pre-transformation stage of curve 1' has to be accelerated so as to enter the "nose" of the transformation curve at a suitable place in order to have a fine pearlite structure. The concept of forced water cooling according to this invention is particularly aimed at having a rapid cooling speed at a pre-transformation stage. Curve 1 illustrated the cooling progress in the period of the forced water cooling treatment and curve 2 showed the next stage in a "soft" conventional WAP process. Curve 3 is the cooling curve during transformation (also in the "soft" conventional WAP process). Further cooling in the post-transformation stage occurs in the air and is shown by cooling curve 4.

Referring now to FIG. 2 and as a matter of another example, a steel wire 10 with a diameter D of 10 mm (S3) is led out of a furnace 12 having a temperature T of about 1000° C. The wire speed V is about 10 m/min. A water bath 14 of an overflow-type is situated immediately downstream the furnace 12. A plurality of jets 16 from the holes 20 of a hollow plate (perforated plate) 22 immersed inside said coolant bath are forming an impinging liquid, whose flow rate is controlled by a circulation pump 18 outside the coolant bath. As illustrated in FIG. 2, the impinging liquid under pressure is rushing up from the holes 20 jetting towards said steel wire 10.

The first length $l_1$ is due to the positioning of the forced water cooling equipment. The forced water cooling equipment might be installed just at the exit of the furnace ($l_1$=0) or a small distance away from the exit. The length $l_1$ can be adjustable as required. The second length $l_2$ indicates the length used for forced water cooling process—forced water cooling length. The third length $l_3$ is the remaining cooling length in the same water coolant bath 14. FIG. 2 illustrates the setup with this wire (S3) running through the whole cooling installation and FIG. 3 is the cross-section according to plane A-A.

The magnetic point, indicating the start of the austenite to pearlite transformation was measured using a magnet and is indicated in table 1 (Magtrans—defined as the distance away from the exit of the furnace). The tensile strength was also measured and indicated in table 1 together with other four samples (S1 and S2 and S4 and S5, S1 is the reference wire through a conventional WAP while S2 to S5 are the wires through the inventive process—forced water cooling treatment).

For the present examples starting product is a plain carbon steel wire rod. This steel wire rod has following steel composition: a carbon content of 0.60%, a manganese content of 0.50%, a silicon content of 0.202%, a sulphur content of 0.013%, a phosphorus content of 0.085%, all percentages being percentages by weight.

A typical steel wire rod composition for high-tensile steel wire has a minimum carbon content of around 0.80 weight %, e.g. 0.78-1.02 weight %, a manganese content ranging from 0.30% to 1.10%, a silicon content ranging from 0.15% to 1.30%, a maximum sulphur content of 0.15%, a maximum phosphorus content of 0.20%, all percentages being percentages by weight. Additional micro-alloying elements may also be added, such as chromium from 0.20% to 0.40%, copper up to 0.20%, vanadium up to 0.30%.

Table 1 further illustrates the effect of low and high pump flow rates in the installation. The situation acted on the last sample S5 is extreme since in normal conditions the flow rate is between 6 and 10 $m^3$/h. During the last two trials (S4, S5), with the same forced cooling length $l_2$=0.6 m and the same "soft" water cooling length $l_3$=2.6 m, the position of the start of transformation was measured respectively using a magnet for different pump flow rates. A clear correlation between the distance from the furnace to the transformation point and the flow rate was found as shown in FIG. 4.

However, according to this invention, the parameter—the pump flow rate is calculated as the sum of the jets from all the holes. If the size of the holes is fixed, the more the holes, the higher the flow rate; if the number of the holes is fixed, the bigger the holes, the higher the flow rate. Further, the higher the pump flow rate, the higher the forced cooling speed.

Ideally the system should provide the same cooling speed irrespective of the travelling path of the steel wires. Indeed the steel wires may change somewhat from travelling path. In case only one set of holes is provided for one steel wire, a changing travelling path may cause changing cooling speeds and this is to be avoided. This can be avoided by providing various types of distributions of the holes. For example, there may be an at random distribution of holes.

FIG. 5 and FIG. 6 show two kinds of distributions of holes. $W_1$ to $W_I$ represents the width between each line of holes; the width can be different from each other or the same as each other.

In FIG. 5 the widths $W_1$ to $W_{i-2}$ may vary while in FIG. 6 the diameter of the holes may vary.

The diameter of the holes preferably ranges from 0.5 mm to 5.0 mm, e.g. 1.0 mm, 2.5 mm, 4.0 mm, and the length between two adjacent holes along the same line are preferably larger than 5.0 mm, e.g. 6.8 mm, 8.2 mm, 10.6 mm. The holes 52 shown in FIG. 5 share the same diameter d1=3 mm. The length $l_{01}$ between two adjacent holes along each line is the same: $l_{01}$=15 mm; the width between each line of holes ($W_1$ to $W_{i-2}$) is different from each other. Comparatively, as shown in FIG. 6, there are two kinds of holes 62 and 64 with different sizes respectively: d1=3 mm and $d_2$=4 mm. The length between two adjacent holes along each line is differ-

TABLE 1

| Sample | V × D, $m^3$/min | D, mm | % C | T, ° C. | $l_1$, m | $l_2$, m | Flow $m^3$/h | $l_3$, m | Rm, N/$mm^2$ | Magtrans, m |
|---|---|---|---|---|---|---|---|---|---|---|
| S1 | 100 | 10 | 0.6 | 1000 | 0.5 | 0 | 0 | 0.6 | 960 | 4.30 |
| S2 | 100 | 10 | 0.6 | 1000 | 0.5 | 1.45 | 8.5 | 0.1 | 970 | 2.20 |
| S3 | 100 | 10 | 0.6 | 1000 | 0.5 | 1.45 | 8.5 | 1.7 | 990 | 2.50 |
| S4 | 100 | 10 | 0.6 | 1000 | 0.5 | 0.6 | 6 | 2.6 | 990 | 3.00 |
| S5 | 100 | 10 | 0.6 | 1000 | 0.5 | 0.6 | 17 | 2.6 | 1000 | 2.30 |

ent from each other in this figure: $l_{02}$=5.5 mm and $l_{03}$=15.0 mm and $l_{04}$=20.8 mm; the width between each line of holes is the same: $W_{i-1}=W_i$. The number of holes is also different in each individual line in order to have different cooling speed of individual travelling path of the steel wires. It is obvious that such a design is applied to cool a plurality of previously heated steel wires with different diameters at the same time.

As illustrated in FIG. 5 and FIG. 6, the holes might be located just below the steel wire or wires. For a forced water cooling equipment used for a plurality of previously heated steel wires, holes might be different from individual line to line (as shown in FIG. 6) in order to have different flow rates, further contributes to different cooling speeds, which needs to be well calculated and controlled. Different flow rates may be useful to treat wires of a different diameter. Another feasible way is to use steel plates to cover some of the holes to reduce the total number of the jets further to control the forced water cooling length in a necessary path in order to meet the needs of a slower flow rate and further a decreased cooling speed.

FIG. 7 illustrates the working principle of a movable steel plate 70 which is put above the holes 72 of a hollow plate (perforated plate) 74 thus to control the numbers of the holes and further the jets and further the forced water cooling length. Such a forced water cooling equipment is quite flexible, which can realize the transformation cooling of thick steel wires with different diameters in different individual travelling paths within the same coolant bath.

FIG. 8 is a reference microstructure for S1 cooled with a short length in the WAP ($l_3$ of S1). FIGS. 9 and 10 are micrographs corresponding to S2 and S3, respectively. The observation of samples showed that more lamellar pearlite was present in the reference S1. In the region close to the surface, in samples S2 and S3 less lamellar pearlite was present, due to the faster cooling via the forced water cooling process.

The tensile properties of other samples cooled with the prototype are significantly higher than those of reference S1 and are close to the expected tensile strength of a 10 mm lead-patented wire rod with 0.6 wt % C (target value 1010 N/mm$^2$).

The invention claimed is:

1. A method of controlled cooling of one or multiple previously heated and substantially straight steel wires to a predetermined temperature range, the method comprising the steps of:

a) guiding the one or multiple previously heated and substantially straight steel wires along individual paths through a coolant bath, the coolant bath comprising a bath liquid and a stabilizing polymer, the bath liquid comprising water and having a temperature of more than 80° C., the bath liquid creating a steam film around each of the one or multiple previously heated and substantially straight steel wires itself along each individual path;

b) directing an impinging liquid immersed inside the coolant bath towards the steam film over a length L along the individual paths such that a thickness of the steam film is decreased or the steam film is destabilized, thereby increasing a speed of cooling over the length L along the individual path;

wherein the impinging liquid is immersed below one previously heated and substantially straight steel wire itself along the individual path, or the impinging liquid is immersed partially below some of the multiple previously heated and substantially straight steel wires along their individual paths.

2. The method according to claim 1, wherein the length L along each individual path is smaller than a length of the coolant bath.

3. The method according to claim 2, wherein the impinging liquid has a same chemical composition as the bath liquid.

4. The method according to claim 3, wherein the impinging liquid is taken from the coolant bath.

5. The method according to claim 4, wherein the impinging liquid is continuously recirculated.

6. The method according to claim 1, wherein a diameter of each of the previously heated and substantially straight steel wires ranges from 5.5 mm to 20 mm.

7. The method according to claim 6, wherein the diameter of each of the previously heated and substantially straight steel wires ranges from 6.5 mm to 13.5 mm.

8. The method according to claim 1, wherein each of the previously heated and substantially straight steel wires is subjected to a controlled cooling-transformation treatment from austenite to pearlite.

9. The method according to claim 8, wherein each of the previously heated and substantially straight steel wires is previously heated above austenitizing temperature and cooled at a predetermined temperature between 400° C. and 650° C.

10. The method according to claim 9, wherein a transformation from austenite to pearlite occurs substantially after the one or multiple of the previously heated and substantially straight steel wires leave the length L.

11. The method according to claim 1, wherein the method comprises controlled cooling of multiple previously heated and substantially straight steel wires, and wherein longitudinal directions of the multiple previously heated and substantially straight steel wires are substantially parallel to each other.

12. An equipment for controlled cooling of one or multiple previously heated steel wires to a predetermined temperature range, said equipment being adapted to carry out a method according to claim 1.

13. An equipment according to claim 12, said equipment comprising:

a) a coolant bath, said coolant bath comprising water and a stabilizing polymer as bath liquid, said bath liquid having a temperature of more than 80° C.;

b) guiding means for guiding one or multiple previously heated steel wires continuously along individual paths through said coolant bath;

c) an impinging liquid generator immersed inside said coolant bath being adapted to jet impinging liquid towards each steel wire along individual path.

14. The method according to claim 3, wherein the coolant bath and the impinging liquid consists of the water and the stabilizing polymer.

15. The method according to claim 1, wherein the stabilizing polymer comprises alkalipolyacrylates or sodium polyacrylate.

16. A method of controlled cooling of a straight steel wire to a predetermined temperature range, the method comprising the steps of:

a) guiding the straight steel wire, which has been previously heated, along an individual path through a coolant bath, the coolant bath comprising a bath liquid and a stabilizing polymer, the bath liquid comprising water and having a temperature of more than 80° C., the bath liquid creating a steam film around the straight steel wire along the individual path;

b) directing an impinging liquid immersed inside the coolant bath towards the steam film over a length L along the individual path such that a thickness of the steam film is decreased or the steam film is destabilized, thereby increasing a speed of cooling over the length L along the individual path;

wherein the impinging liquid is immersed below the straight steel wire itself along the individual path.

* * * * *